US006768480B2

(12) United States Patent
Jinno

(10) Patent No.: US 6,768,480 B2
(45) Date of Patent: Jul. 27, 2004

(54) ACTIVE MATRIX DISPLAY DEVICE AND INSPECTION METHOD THEREFOR

(75) Inventor: Yushi Jinno, Gifu (JP)

(73) Assignee: Sanyo Electric Co., Ltd. (JP)

( * ) Notice: Subject to any disclaimer, the term of this patent is extended or adjusted under 35 U.S.C. 154(b) by 282 days.

(21) Appl. No.: 10/109,146

(22) Filed: Mar. 27, 2002

(65) Prior Publication Data

US 2002/0167472 A1 Nov. 14, 2002

(30) Foreign Application Priority Data

Mar. 30, 2001 (JP) ..... 2001-102303

(51) Int. Cl.[7] ..... G09G 3/30

(52) U.S. Cl. ..... 345/80; 345/76; 345/205; 345/212

(58) Field of Search ..... 315/169.1, 169.2, 315/169.3; 345/76, 78, 80, 205, 211, 212, 90, 98, 99

(56) References Cited

U.S. PATENT DOCUMENTS

| | | | | |
|---|---|---|---|---|
| 4,532,506 A | * | 7/1985 | Kitazima et al. | 345/90 |
| 4,621,260 A | * | 11/1986 | Suzuki et al. | 345/92 |
| 5,926,158 A | * | 7/1999 | Yoneda et al. | 345/90 |
| 6,278,426 B1 | * | 8/2001 | Akiyama | 345/87 |
| 6,614,415 B2 | * | 9/2003 | Mizutani et al. | 345/90 |
| 6,621,477 B1 | * | 9/2003 | Inoue et al. | 345/92 |

* cited by examiner

*Primary Examiner*—Kent Chang
(74) *Attorney, Agent, or Firm*—Cantor Colburn LLP

(57) ABSTRACT

When a first transistor for switching Tr1 is ON by a gate signal, a voltage signal in accordance with a data voltage signal input to the source terminal of the first transistor Tr1 is held in a storage capacitor. A second transistor Tr2 controls an amount of current supplied to an emissive element from a power source line PVdd in accordance with the voltage signal, and a charge is accumulated in an additional capacitor C2 in accordance with the amount of current thus controlled. Defect inspection corresponding to the actual display state can be performed by examining the charge accumulated in the additional capacitor C2.

6 Claims, 6 Drawing Sheets

ACTIVE MATRIX DISPLAY DEVICE AND INSPECTION METHOD THEREFOR

BACKGROUND OF THE INVENTION

1. Field of the Invention

The present invention relates to a display device using TFTs (Thin Film Transistors), such as an OEL (Organic Electroluminescence) display device.

2. Description of Related Art

A conventional active matrix display device using TFTs will be described with reference to FIG. 1, which shows an equivalent circuit for one pixel. As shown in FIG. 1, each pixel of a display device having an OEL as a display element basically comprises a first transistor Tr1 for switching, a second transistor Tr2 for driving an element, and a storage capacitor C.

The drain terminal (D) of the first transistor Tr1 is connected to an input line for a data voltage signal (Vdata) while the gate terminal (G) of the first transistor Tr1 receives an externally input gate signal (Gate Sig). Further, the source terminal (S) of the first transistor Tr1 is connected with one end of the storage capacitor C and with the gate terminal (G) of the second transistor Tr2. The other end of the storage capacitor C is connected with a $V_{SC}$ line.

A power source voltage PVdd is applied to the source terminal (S) of the second transistor Tr2, and the drain terminal (D) of the second transistor Tr2 is connected to an anode of the OEL element.

In conventional display devices, a data voltage signal corresponding to a desired gray scale value is applied to the drain terminal (D) of the first transistor Tr1 and a gate signal is input to the gate (G) of the transistor Tr1, so that the first transistor Tr1 is turned on and a charge in accordance with a voltage value of the data voltage signal is held in the storage capacitor C. The conducting state (resistance) between the source (S) and the drain (D) of the second transistor Tr2 is controlled by the amount of charge held in the storage capacitor C. Further, the OEL element is driven by the current value which is determined by the power source voltage PVdd and the controlled resistance. More specifically, the resistance value of the second transistor Tr2, and thus the current value applied to the OEL, is controlled by the data voltage signal input to the first transistor Tr1, so that the OEL emits light with a brightness that will produce a desired gray scale image.

Active matrix display devices as described above have attracted attention as having promise for the next generation of displays because they are of a self-emission type and thin, and, because they can be driven with less power, they reduce power consumption. However, these display devices are still in the stage of research and development, and no devices have yet been proposed for inspecting defects of each pixel precisely and effectively with a low cost.

Active matrix TFT LCDs, display devices having a TFT for each pixel, are widely used today. In a TFT LCD, the liquid crystal is controlled by a voltage applied thereto via each pixel TFT. Accordingly, when inspecting the TFT substrates in such LCDs, commonly the charge accumulation state on each storage capacitor C is measured to determine the quality of each transistor.

However, when controlling the emission gray scale of OELs by means of conventional current value control as described above, there has been problem in that, while the brightness of an emissive element is controlled by a source-drain current of the second transistor Tr2 whose gate voltage is controlled by a voltage held by the first transistor Tr1 and the storage capacitor C, a specialized measuring device is required in order to measure this current value for inspection purposes. In other words, conventional testers cannot be used for inspection, making it difficult and expensive to search for defects by perform inspections corresponding to actual display states.

SUMMARY OF THE INVENTION

The present invention was conceived in view of the aforementioned problems of the related art and provides a display device simplifying performance of defect inspection corresponding to the actual display state.

In order to overcome the above-described problems, in accordance with the present invention, there is provided an active matrix display device in which each of pixels comprises a display element; a first transistor for switching; a storage capacitor for holding a voltage signal supplied thereto via said first transistor, when the first transistor is ON; a second transistor for driving an element, which supplies power from a power source line to the display element, in accordance with the voltage signal which is held by the storage capacitor and is applied to the gate of the second transistor; and an additional capacitor which is connected such that a charge is accumulated therein by a current flowing from the second transistor to the display element.

In accordance with another aspect of the present invention, the additional capacitor is used for inspection of the active matrix display device and a matrix array substrate having the pixels formed on a substrate. Here, it is also preferable that the display element is an emissive element which emits light with brightness determined by the supplied power, and that the additional capacitor controls an amount of power supplied to the display element within a unit time period to thereby control emission brightness of the display element.

In order to overcome the foregoing problems, there is also provided a method of inspecting a display device as described above, the method comprising the steps of driving each of the pixels to accumulate a charge in the additional capacitor; measuring an amount of charge accumulated in the additional capacitor; and inspecting uniformity among currents supplied to each display element using the amount of charge measured for each display element.

In accordance with another aspect of the present invention, there is provided an active matrix semiconductor device in which each cell comprises a cell element; a first transistor for switching; a storage capacitor for holding a voltage signal supplied thereto via the first transistor, when the first transistor is ON; a second transistor for driving an element, which supplies power from a power source line to the cell element, in accordance with the voltage signal which is held by the storage capacitor and is applied to the gate of the second transistor; and an additional capacitor which is connected such that a charge is accumulated therein by a current flowing from the second transistor to the cell element.

According to the present invention, an active matrix device may be configured as follows. Namely, in each pixel or cell, when a first transistor for switching is ON, a storage capacitor holds a voltage signal supplied thereto via the first transistor. The voltage signal thus held in the storage capacitor is applied to the gate of a second transistor, which then supplies power from a power source line to a display element in accordance with the voltage signal. An additional transistor is further provided and connected such that it accumulates a charge by a current flowing from the second transistor to the display element. With this structure, by measuring the amount of charge accumulated in the additional capacitor after the display element is driven, it is possible to directly inspect the amount of current supplied to the display element via the second transistor, and defect inspection corresponding to the actual display state can be easily performed.

BRIEF DESCRIPTION OF THE DRAWINGS

These and other objects of the invention will be explained in the description below, in connection with the accompanying drawings, in which.

DETAILED DESCRIPTION OF THE PREFERRED EMBODIMENT

A preferred embodiment of the present invention will be described in further detail with reference to the accompanying drawings.

Figure 1:
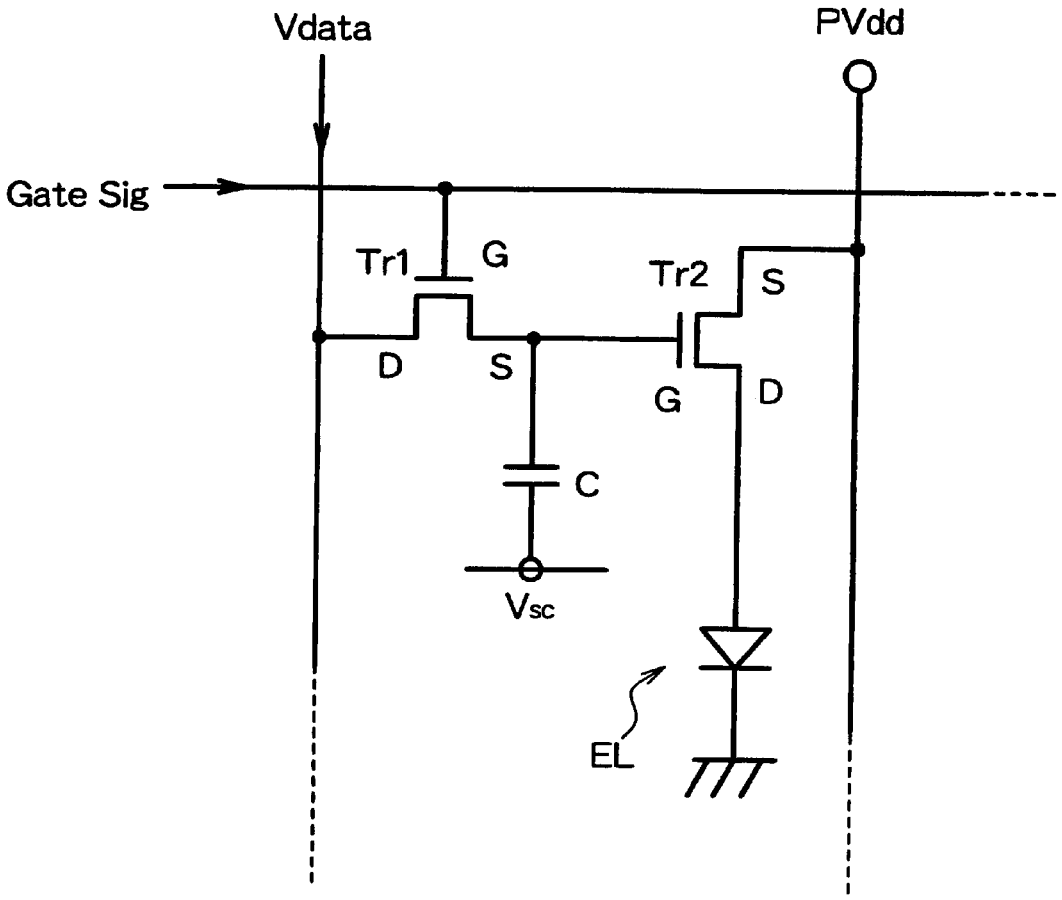
Fig. 1 PRIOR ART
FIG. 1 a circuit diagram showing an equivalent circuit for one pixel of a conventional active matrix display device.
Figure 2:
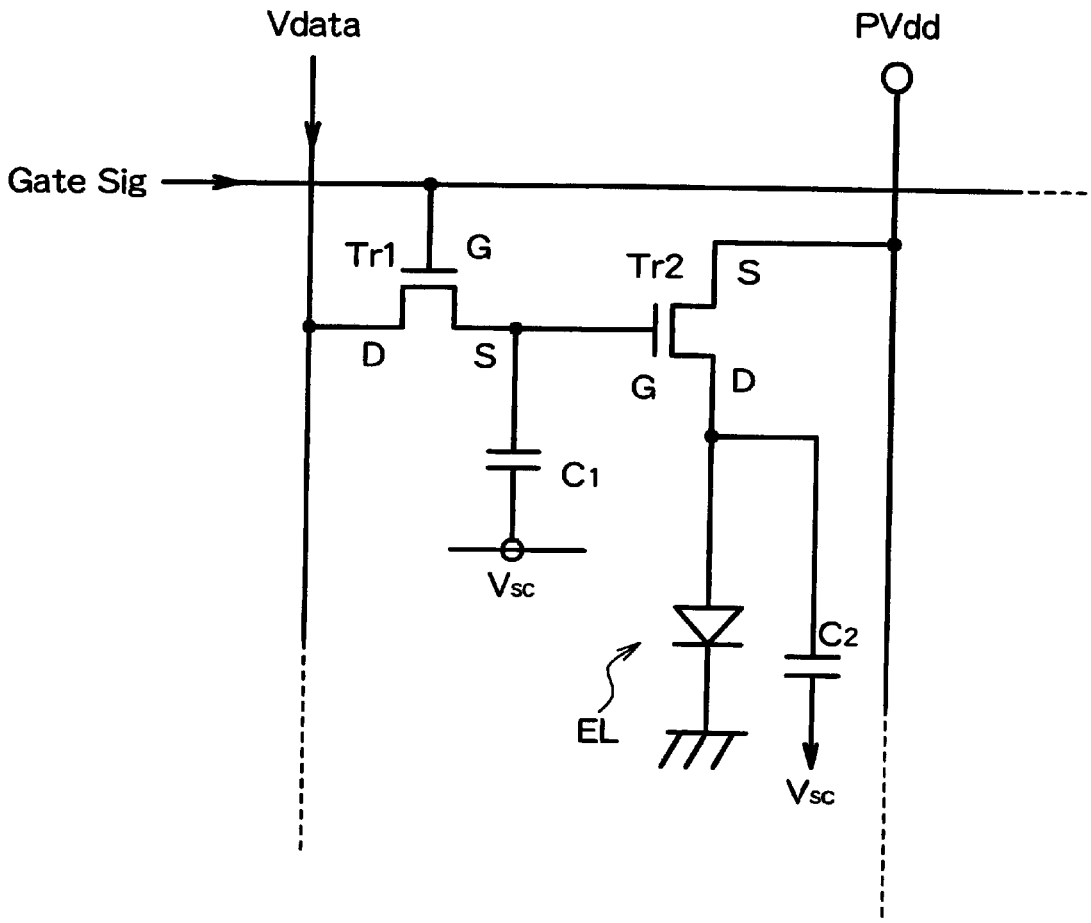
FIG. 2 is a circuit diagram showing an equivalent circuit for one pixel of an active matrix display device in accordance with an embodiment of the present invention.

FIG. 2 shows an equivalent circuit for one pixel of an active matrix display device in accordance with one embodiment of the present invention. In a display device according to this embodiment and including an OEL as a display element, each pixel basically comprises a first transistor Tr1 for switching, a second transistor Tr2 for driving an element, a storage capacitor C1, and an additional capacitor C2. A plurality of pixels each having such a structure may be provided in a matrix on a substrate to form a matrix array substrate. Further, a predetermined sealing member may be provided on a surface of the matrix array substrate where the elements are formed, for example, to thereby form a display device.

In the example of the present embodiment, the drain terminal (D) of the first transistor Tr1 is connected with an input line for a data voltage signal (Vdata), and the gate terminal (G) of the first transistor Tr1 receives an externally input gate signal (Gate Sig). The source terminal (S) of the first transistor Tr1 is connected with one end of the storage capacitor C1 and with the gate terminal (G) of the second transistor Tr2. The other end of the storage capacitor C1 is connected with a $V_{SC}$ line.

A power source voltage PVdd is applied to the source terminal (S) of the second transistor Tr2, and the drain terminal (D) of the second transistor Tr2 is connected with an anode of the OEL element which includes at least an organic emissive material, and with one end of the additional capacitor C2. The other end of the additional capacitor C2 is connected with the $V_{SC}$ line.

The operation of this circuit will be described. A data voltage signal in accordance with a desired gray scale is applied to the drain terminal (D) of the first transistor Tr1 and a gate signal is input to the gate terminal (G) of the first transistor Tr1. As a result, the first transistor Tr1 is turned ON. A charge in accordance with the voltage value of the data voltage signal is held in the storage capacitor C1.

The conducting state (resistance) between the source terminal (S) and the drain terminal (D) of the second transistor Tr2 is controlled by the charge amount held in the storage capacitor C1. The OEL element is driven by a current value which is determined by the power source voltage PVdd and the resistance value thus controlled. At this point, power is also supplied to one end of the additional capacitor C2, so that a charge in accordance with the supplied power is accumulated in the additional capacitor C2.

Figure 3:
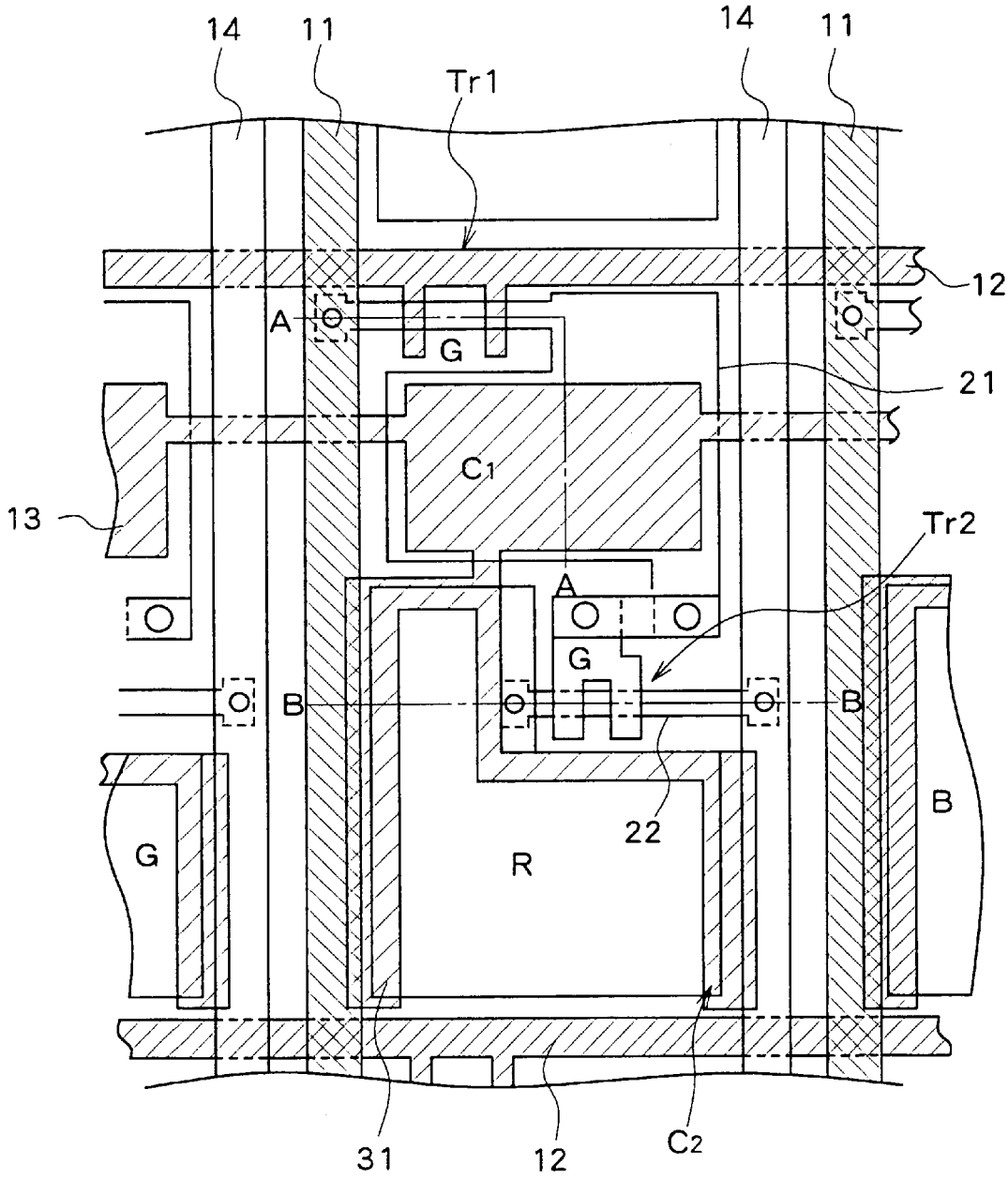
FIG. 3 is a plan view showing the vicinity of an EL pixel of an active matrix display device in accordance with the embodiment of the present invention.
Figure 4:
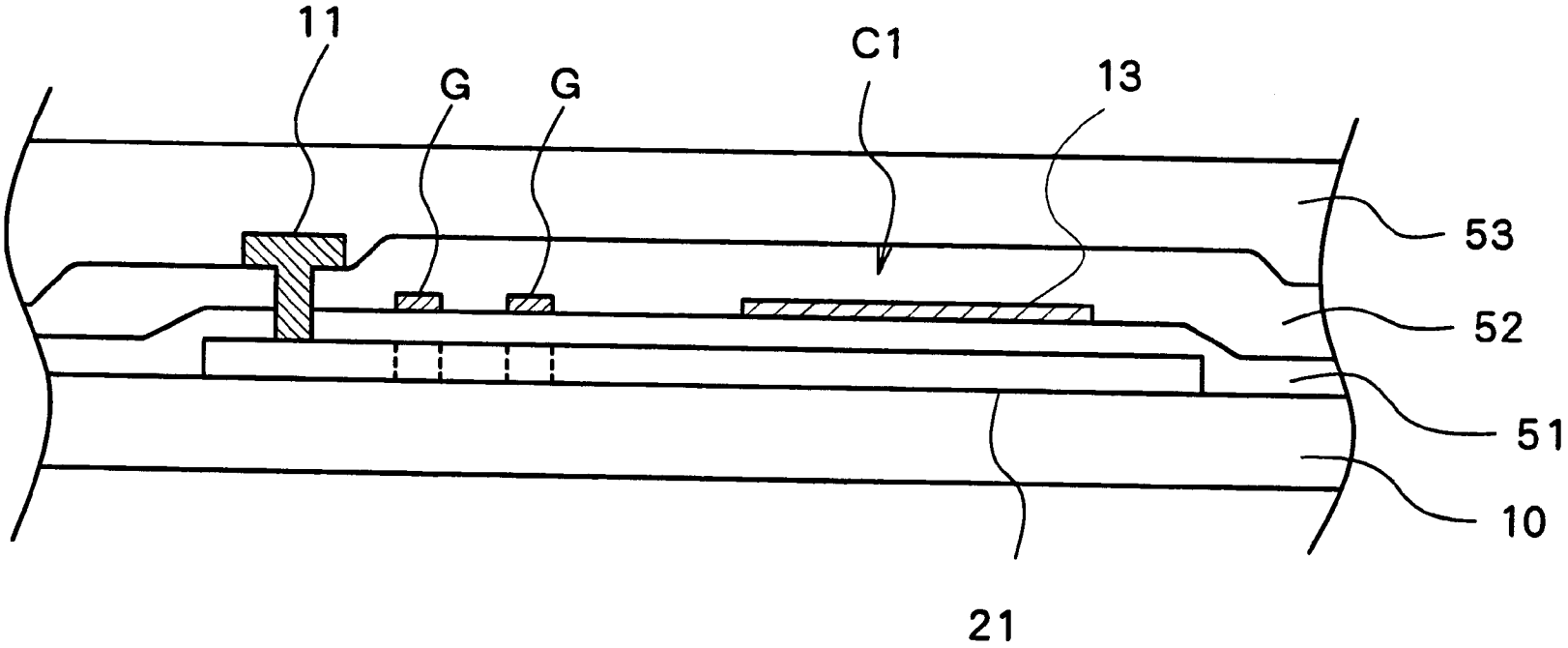
FIG. 4 is a schematic cross sectional view taken along line A—A of FIG. 3.
Figure 5:
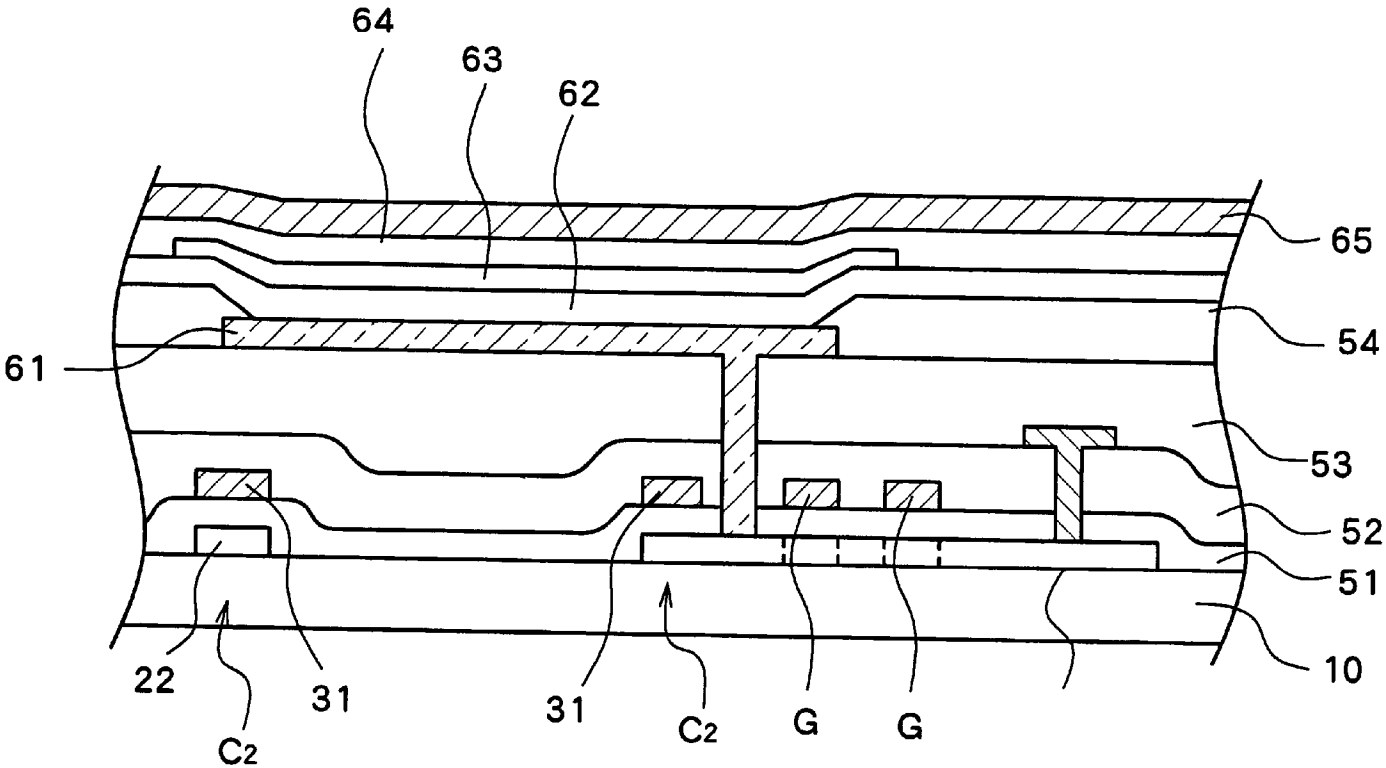
FIG. 5 is a schematic cross sectional view taken along line B—B of FIG. 3.

FIG. 3 is a plan view showing the vicinity of the EL pixel of the active matrix display device in which each pixel is illustrated by an equivalent circuit of the type shown in FIG. 2. FIGS. 4 and 5 are schematic cross sectional views taken along lines A—A and B—B, respectively, of FIG. 3. As shown in FIG. 3, one pixel region is defined by a data line 11 extending in the column direction and a gate line 12 extending in the row direction. In one pixel region, the first transistor Tr1, the storage capacitor C1, the second transistor Tr2, an emissive region R and the additional capacitor C2 are arranged. The storage capacitor C1 is formed by an island pattern 21 extending from the drain portion of the first transistor Tr1 which is formed on the substrate 10 such as a glass substrate and an island pattern on the $V_{SC}$ line 13 which is laminated on this island pattern 21 via a gate insulting film 51. From the island pattern 21, a line extends from the drain portion to the source portion of the first transistor Tr1 and is connected to the data line 11. On this line, the gate insulating film 51 and the gate electrode (G) are laminated, and an interlayer insulating film 52 and a first planarizing insulating layer 53 are further laminated, in that order.

Further, a line 22 extends, on the substrate 10, from the drain portion of the second transistor Tr2 and is connected with the PVdd line 14. The line 22 also intersects with the gate electrode G via the gate insulating film 51, and extends along the electrode 31 which forms the additional capacitor C2. The electrode 31 is connected with the island pattern on the $V_{SC}$ line 13 (one electrode of the storage capacitor C1).

One electrode of the additional capacitor C2 can be formed by slightly changing the pattern of the line 22 while the other electrode 31 can be formed on the gate insulating film on which the gate terminal of the second transistor Tr2 is also formed. More specifically, the electrode 31 can be formed in the same layer as the $V_{SC}$ line 13 of the storage capacitor C1 and can be formed integrally with the $_{SC}$ line 13. Therefore, no additional manufacturing steps are required for forming the additional capacitor C2.

Further, according to this embodiment, because a pair of electrodes forming the additional capacitor C2 are formed along the vicinity of the outer periphery of the emission region, reduction in the size of the emission region, namely reduction in the aperture ratio due to the formation of the additional capacitor C2, can be suppressed. Further, considering light diffusion at the time of light emission, brightness is not lost. On the other electrode 31 of the additional capacitor C2 which is formed in the outer periphery of the emissive region as described, the gate terminal (G) and the $V_{SC}$ line 13 of the storage capacitor C1, the interlayer insulating film 52 and the first planarizing insulating film 53 are sequentially laminated in that order. On the additional capacitor C2, for example, an anode 61, a hole transport layer 62, an emissive layer 63, an electron transport layer 64 are sequentially laminated in that order, and a cathode 65 is then formed on these layers. The edge portions of the anode 61 and the interlayer regions are filled with a second planarizing insulating layer 54. In this embodiment, an organic compound is used in the hole transport layer 62, the emissive layer 63, and the electron transport layer 64.

The active matrix display device of the present embodiment having the above structure operates in the following manner.

[Inspection]

When each pixel of the active matrix display device of the present embodiment is driven in a manner similar to that as in conventional devices, a charge in accordance with the amount of current flowing from the source terminal of the second transistor Tr2 to the emissive element, which is controlled by a voltage held by the first transistor Tr1 and the storage capacitor C, is accumulated in the additional capacitor C2. In this state, the second transistor Tr2 is turned ON, and the charge accumulated in the additional capacitor C2 of each pixel is measured from the power source line PVdd side. It is here preferable that the capacitance of the additional capacitor C2 be on the order of approximately several 10 fF (several $10^{-15}$F) or greater.

When performing such an inspection, when the amount of charge accumulated in the additional capacitor C2 of any one pixel significantly differs from that of other pixels, it is determined that the current value supplied to the emissive element of that pixel is not proper. In this manner, it is possible to directly inspect the abnormality of the current value flowing to each emissive element.

Because it is the charge amount of the additional capacitor C2 that is measured during inspection, it is possible to use a conventional TFT inspection device (used for measuring the charge amount of the storage capacitor C) for LCDs for the purpose of the present embodiment.

[Relaxation of Power-Brightness Characteristics]

Further, when controlling an emissive element including a material whose characteristics (power value/brightness characteristics) change rapidly such that the change in brightness relative to the change in power value is significant, control using, for example, a low temperature polysilicon TFT so as to obtain a desired gray scale, is difficult because it is difficult to control the voltage value to the gate of the TFT. In such instances, significant impedance change is required at the TFT side. Conventionally, this has been dealt with by employing an emissive material having different physical property. However, according to this embodiment of the present invention, it is possible to control the effective value of the voltage applied to the emissive element and the current amount per unit time period which flows into the emissive element by means of the time constant of a product RC provided by the capacitance C of the additional capacitor C2 and the resistance R when the transistor Tr2 is ON. Thus, the step width of the gray scale can be effectively expand without changing the emissive element material, thereby facilitating the brightness control. In this case, the capacitance C of the additional capacitor C2 is set such that the time constant CR of a product obtained by the capacitance C and the resistance R of the second transistor Tr2 is substantially equal to that of the drive frequency (in NTSC, 60 Hz, namely 1/60 sec).

Further, when an emissive material having a high response speed, such as an OEL, and a fluorescent material are used in a situation wherein high frequency noise occurs in the voltage signal line PVdd, brightness changes in response to the noise, resulting in generation of so-called "flicke ing". According to the present invention, when the capacitance C of the additional capacitor C2 is set properly, the additional capacitor C2 functions as a low pass filter for cutting the high frequency noise, and, therefore, generation of flicker can be reduced. In this case, it is preferable that the CR time constant is one several hundredths of the drive frequency or smaller (about $10^{-5}$ sec or less).

Figure 6:
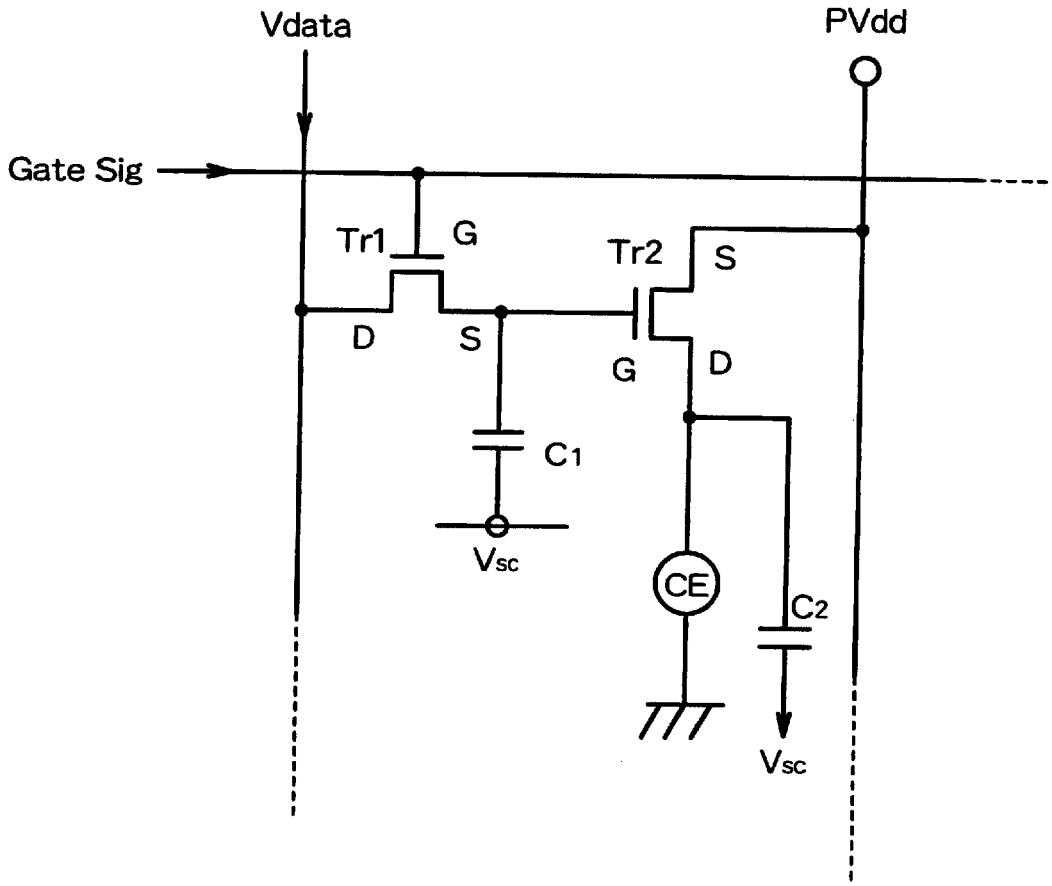
FIG. 6 is a circuit diagram showing an equivalent circuit for one cell of an active matrix semiconductor device in accordance with another example of the present invention.

In the foregoing example, an organic EL element is used as a display element for each pixel in an active matrix display device. However, the present invention is also applicable to a display device using a vaccum fluorescent display (VFD), an LED, an inorganic EL element, or the like. Further, the present invention is not limited to a display device, and is also applicable to a semiconductor device such as a light source and various sensors. FIG. 6 shows such a semiconductor device, in which a plurality of cells are arranged in a matrix on a substrate. As shown in FIG. 6, each cell includes first and second transistors Tr1 and Tr2 formed of poly-crystalline silicon, a storage capacitor C1 and an additional capacitor C2, as in the example shown in FIG. 2. A cell element employs a structure of an emissive element such as an EL element similar to the example of FIG. 2, a light receiving element, a temperature sensor element, a pressure sensor element, a field sensor element, a magnetic field sensor, or the like. In an active matrix semiconductor device as described above, inspection of each cell and control of power supply to each cell element can be similarly achieved by providing an additional capacitor C2 which is charged by a charge supplied to the cell element.

While the preferred embodiment of the present invention has been described using specific terms, such description is for illustrative purposes only, and it is to be understood that changes and variations may be made without departing from the spirit or scope of the appended claims.

What is claimed is:

1. An active matrix display device in which each pixel comprises:

a display element;

a first transistor for switching;

a storage capacitor for holding a voltage signal supplied thereto via said first transistor, when said first transistor is ON;

a second transistor for driving an element, which supplies power from a power source line to said display element, in accordance with the voltage signal which is held by said storage capacitor and is applied to the gate of the second transistor; and an additional capacitor which is connected such that a charge is accumulated therein as a result of a current flowing from said second transistor to said display element.

2. An active matrix display device according to claim 1, wherein said additional capacitor is used for inspection of said active matrix display device and a matrix array substrate having said pixels formed on a substrate.

3. An active matrix display device according to claim 1, wherein said display element is an emissive element which emits light of a brightness corresponding to the supplied power, and said additional capacitor controls the amount of power supplied to said display element within a unit time period to thereby control the emission brightness of said display element.

4. A method of inspecting a display device according to claim 1, said method comprising the steps of:

driving each of said pixels to accumulate a charge in said additional capacitor;

measuring the amount of charge accumulated in said additional capacitor; and inspecting the uniformity of the amount of current supplied to each display element based on the amount of charge measured for each display element.

5. An active matrix display device according to claim 1, wherein said display element is an organic electroluminescence element including an organic emissive material as an emissive material.

6. An active matrix semiconductor device in which each cell comprises:

a cell element;

a first transistor for switching;

a storage capacitor for holding a voltage signal supplied thereto via said first transistor, when said first transistor is ON;

a second transistor for driving an element, which supplies power from a power source line to said cell element, in accordance with the voltage signal which is held by said storage capacitor and is applied to the gate of the second transistor; and an additional capacitor which is connected such that a charge is accumulated therein as a result of a current flowing from said second transistor to said cell element.

* * * * *